US008020510B2

(12) United States Patent
Emoto et al.

(10) Patent No.: US 8,020,510 B2
(45) Date of Patent: Sep. 20, 2011

(54) COATING DIE HAVING FRONT AND BACK CONCAVE SURFACES CORRESPONDING TO NARROW CENTRAL ANGLES OF THE GUIDE ROLL

(75) Inventors: Kazutoshi Emoto, Tokyo (JP); Kazuo Katai, Tokyo (JP); Kiyonori Hinoki, Tokyo (JP); Yousuke Miyaki, Tokyo (JP)

(73) Assignee: TDK Corporation, Tokyo (JP)

( * ) Notice: Subject to any disclaimer, the term of this patent is extended or adjusted under 35 U.S.C. 154(b) by 696 days.

(21) Appl. No.: 12/122,959

(22) Filed: May 19, 2008

(65) Prior Publication Data

US 2008/0295765 A1 Dec. 4, 2008

(30) Foreign Application Priority Data

May 31, 2007 (JP) ..... P2007-145958

(51) Int. Cl.

| | |
|---|---|
| ***B05C 3/02*** | (2006.01) |
| ***B05C 3/00*** | (2006.01) |
| ***B05C 3/12*** | (2006.01) |
| ***B05C 11/02*** | (2006.01) |
| *B05D 3/12* | (2006.01) |

(52) U.S. Cl. ..... 118/410; 118/56; 118/411; 118/416; 118/419; 427/356; 427/358

(58) Field of Classification Search ..... 118/56, 118/410, 416, 419; 427/356, 358
See application file for complete search history.

(56) References Cited

U.S. PATENT DOCUMENTS

| | | | | |
|---|---|---|---|---|
| 3,063,868 | A * | 11/1962 | Brandsma et al. | 427/348 |
| 3,584,600 | A * | 6/1971 | Ishiwata et al. | 118/119 |
| 3,690,917 | A * | 9/1972 | Hershoff | 430/495.1 |
| 4,143,190 | A * | 3/1979 | Choinski | 427/420 |
| 4,933,215 | A * | 6/1990 | Naruse et al. | 427/420 |
| 4,995,339 | A * | 2/1991 | Tobisawa et al. | 118/410 |
| 5,376,178 | A * | 12/1994 | Sato | 118/411 |
| 5,582,645 | A * | 12/1996 | Trest et al. | 118/410 |
| 5,728,430 | A * | 3/1998 | Sartor et al. | 427/356 |
| 5,741,549 | A * | 4/1998 | Maier et al. | 427/294 |
| 7,033,644 | B2 * | 4/2006 | Tokimasa et al. | 427/356 |
| 7,546,802 | B2 * | 6/2009 | Kasper et al. | 101/483 |
| 2003/0194497 | A1 * | 10/2003 | Takada et al. | 427/355 |

FOREIGN PATENT DOCUMENTS

| | | |
|---|---|---|
| JP | A-58-202075 | 11/1983 |
| JP | A-62-091265 | 4/1987 |
| JP | A-06-285410 | 10/1994 |
| JP | A-08-249656 | 9/1996 |

OTHER PUBLICATIONS

Foreign Office Action for Japanese Patent Application No. 2007-145958 issued on Jun. 23, 2009.
Notification of First Office Action for corresponding Chinese Patent Application No. 200810109812.4, mailed on Nov. 15, 2010.

* cited by examiner

*Primary Examiner* — Dah-Wei Yuan
*Assistant Examiner* — Karl Kurple
(74) *Attorney, Agent, or Firm* — Oliff & Berridge, PLC

(57) ABSTRACT

A liquid applicator comprises a guide roll for guiding a sheet, and a slit die, having a slit with an opening extending in an axial direction of the guide roll, for applying a liquid to a surface of the sheet guided by the guide roll. On the rear side of the opening in a rotating direction of the guide roll, the slit die further includes a front lip having a concave surface corresponding to the guide roll. The front lip opposes the guide roll by such a length FA in the rotating direction RD of the guide roll as to have a central angle θ of 0.95° to 3.0° about an axis O of the guide roll.

3 Claims, 3 Drawing Sheets

*Fig.3*

| | GUIDE ROLL RADIUS R [mm] | FG,BG [mm] | FRONT LIP | | BACK LIP | | FLUCTUATION IN APPLIED FILM THICKNESS IN WIDTH DIRECTION (%) |
|---|---|---|---|---|---|---|---|
| | | | ANGLE $\theta$ [° ] | LENGTH FE [mm] | ANGLE $\phi$ [° ] | LENGTH BE [mm] | |
| EXAMPLE1 | 60.2 | 0.6 | 0.94 | 1 | 0.7 | 0.74 | 2.9 |
| EXAMPLE2 | 60.2 | 0.6 | 1.41 | 1.5 | 0.7 | 0.74 | 1.8 |
| EXAMPLE3 | 60.2 | 0.6 | 2.36 | 2.5 | 0.7 | 0.74 | 1.2 |
| EXAMPLE4 | 60.2 | 0.6 | 2.83 | 3 | 0.7 | 0.74 | 1.9 |
| COMPARATIVE EXAMPLE1 | 60.2 | 0.6 | 0.91 | 0.97 | 0.7 | 0.74 | 5.4 |
| COMPARATIVE EXAMPLE2 | 60.2 | 0.6 | 3.33 | 3.53 | 0.7 | 0.74 | 5.7 |
| EXAMPLE5 | 55.0 | 0.6 | 0.94 | 0.91 | 0.7 | 0.74 | 1.6 |
| EXAMPLE6 | 55.0 | 0.6 | 1.41 | 1.37 | 0.7 | 0.74 | 1.2 |
| EXAMPLE7 | 55.0 | 0.6 | 2.36 | 2.29 | 0.7 | 0.74 | 1.3 |
| EXAMPLE8 | 55.0 | 0.6 | 2.83 | 2.75 | 0.7 | 0.74 | 1.7 |
| COMPARATIVE EXAMPLE3 | 55.0 | 0.6 | 0.91 | 0.88 | 0.7 | 0.74 | 5.2 |
| COMPARATIVE EXAMPLE4 | 55.0 | 0.6 | 3.33 | 3.23 | 0.7 | 0.74 | 5.4 |
| EXAMPLE9 | 60.2 | 0.1 | 0.94 | 0.99 | 0.7 | 0.74 | 1.3 |
| EXAMPLE10 | 60.2 | 0.1 | 1.41 | 1.48 | 0.7 | 0.74 | 1.1 |
| EXAMPLE11 | 60.2 | 0.1 | 2.36 | 2.48 | 0.7 | 0.74 | 1 |
| EXAMPLE12 | 60.2 | 0.1 | 2.83 | 2.98 | 0.7 | 0.74 | 1.2 |
| COMPARATIVE EXAMPLE5 | 60.2 | 0.1 | 0.91 | 0.96 | 0.7 | 0.74 | 5.1 |
| COMPARATIVE EXAMPLE6 | 60.2 | 0.1 | 3.33 | 3.5 | 0.7 | 0.74 | 5.3 |
| EXAMPLE13 | 60.2 | 0.6 | 0.94 | 1 | 3.7 | 3.92 | 4.2 |
| EXAMPLE14 | 60.2 | 0.6 | 1.41 | 1.5 | 3.7 | 3.92 | 3.8 |
| EXAMPLE15 | 60.2 | 0.6 | 2.36 | 2.5 | 3.7 | 3.92 | 3.6 |
| EXAMPLE16 | 60.2 | 0.6 | 2.83 | 3 | 3.7 | 3.92 | 3.9 |
| COMPARATIVE EXAMPLE7 | 60.2 | 0.6 | 0.91 | 0.97 | 3.7 | 3.92 | 6.3 |
| COMPARATIVE EXAMPLE8 | 60.2 | 0.6 | 3.33 | 3.53 | 3.7 | 3.92 | 7.2 |

COATING DIE HAVING FRONT AND BACK CONCAVE SURFACES CORRESPONDING TO NARROW CENTRAL ANGLES OF THE GUIDE ROLL

BACKGROUND OF THE INVENTION

1. Field of the Invention

The present invention relates to a liquid applicator.

2. Related Background Art

Liquid applicators comprising a guide roll for guiding a sheet, and a slit die, having a slit with an opening extending in an axial direction of the guide roll, for applying a liquid to a surface of the sheet guided by the guide roll have conventionally been known (e.g., Japanese Patent Application Laid-Open Nos. 6-285410 and 8-249656).

SUMMARY OF THE INVENTION

However, they have failed to fully keep an applied liquid film from varying the thickness in the width direction.

In view of the problem mentioned above, it is an object of the present invention to provide a liquid applicator which can fully keep the applied liquid film from varying the thickness in the width direction.

The liquid applicator in accordance with the present invention comprises a guide roll for guiding a sheet, and a slit die, having a slit with an opening extending in an axial direction of the guide roll, for applying a liquid to a surface of the sheet guided by the guide roll. The slit die further includes a front lip, placed on the rear side of the opening in a rotating direction of the guide roll, having a concave surface corresponding to the guide roll. The front lip opposes the guide roll by such a length in the rotating direction of the guide roll as to have a central angle $\theta$ of 0.95° to 3.0° about an axis of the guide roll.

In the present invention, the entrainment of air into the liquid film applied to the sheet after being discharged from the slit is fully reduced by an appropriate length of the front lip, whereby the fluctuation in the thickness of the applied liquid film in the width direction is reduced. When the central angle $\theta$ is less than 0.95° or more than 3.0°, by contrast, the liquid film fluctuates remarkably in the width direction.

Preferably, the slit die further includes a back lip, placed on the front side of the opening in the rotating direction of the guide roll, having a concave surface corresponding to the guide roll, while the back lip opposes the guide roll by such a length in the rotating direction of the guide roll as to have a central angle $\phi$ which is smaller than $\theta$ about the axis of the guide roll.

This can restrain the suction effect generated in the feeding direction of the sheet in the part where the back lip and the guide roll oppose each other from affecting the part where the front lip and the guide roll oppose each other. When the length by which the back lip opposes the guide roll is made such that the central angle $\phi$ is greater than $\theta$, the suction effect occurring in the part where the back lip and the guide roll oppose each other may extend over the part where the front lip and the guide roll oppose each other, which tends to increase the entrainment of air and vary the thickness of the applied liquid film in the width direction.

The present invention can provide a liquid applicator which can fully keep the applied liquid film from varying the thickness in the width direction.

BRIEF DESCRIPTION OF THE DRAWINGS

FIG. 3 is a table showing data and results of examples and comparative examples.

EXPLANATIONS OF NUMERALS OR LETTERS

S . . . sheet; 6 . . . guide roll, 20 . . . slit die, 23 . . . slit; 24 . . . opening; 27 . . . front lip; 28 . . . back lip; 100 . . . liquid applicator

DESCRIPTION OF THE PREFERRED EMBODIMENTS

In the following, preferred embodiments of the applicator in accordance with the present invention will be explained in detail with reference to the drawings. In the following explanation, the same or equivalent parts will be referred to with the same numerals or letters while omitting their overlapping descriptions.

Figure 1:
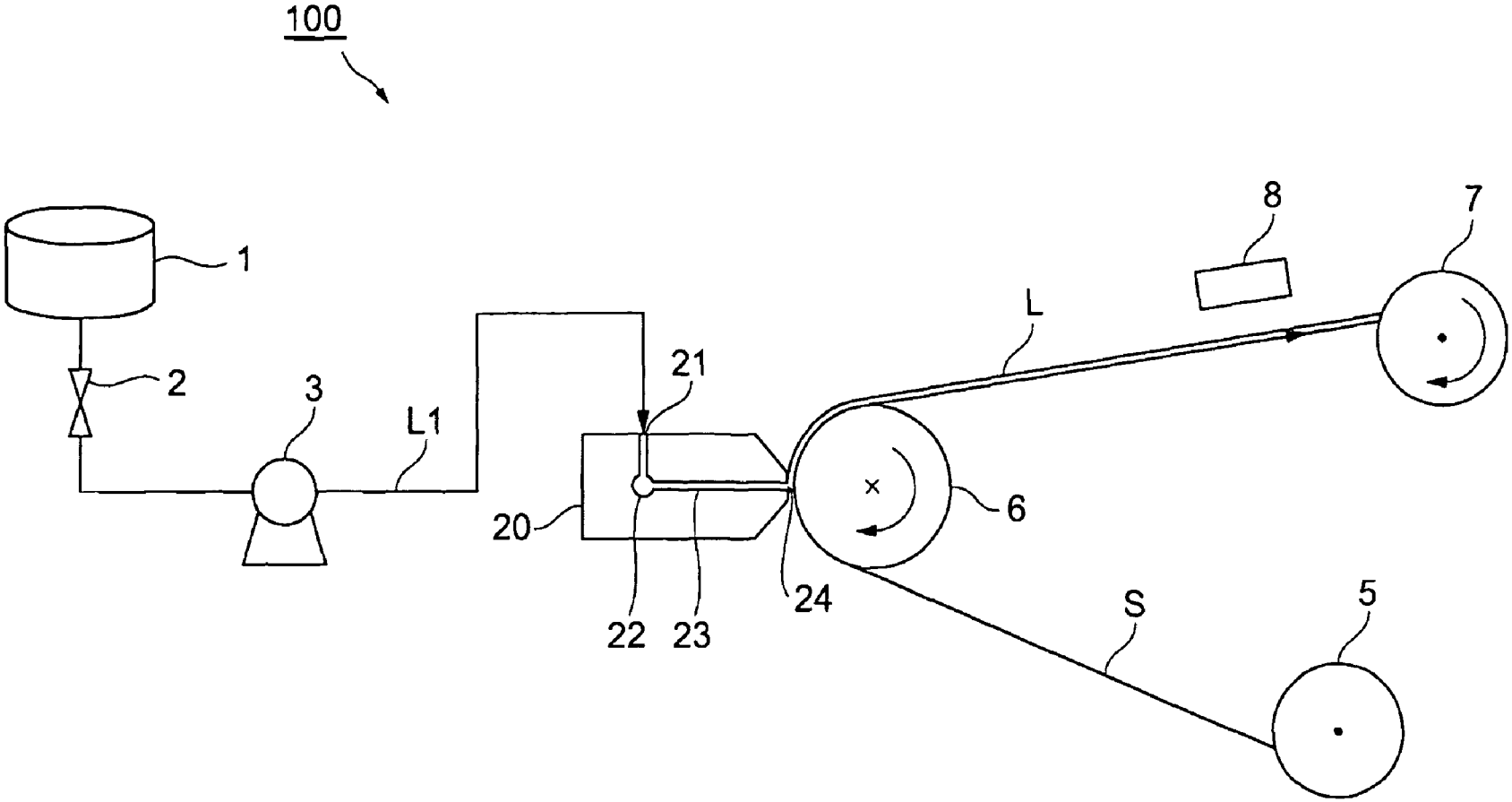
FIG. 1 is a schematic diagram of the liquid applicator in accordance with an embodiment.

As shown in FIG. 1, the applicator of the present invention mainly comprises a reservoir tank 1, a liquid feed pump 3, a slit die 20, a sheet feed reel 5, a guide roll 6, a take-up reel 7, and a dryer 8.

The reservoir tank 1 stores a liquid to be applied. Though not restricted in particular, examples of the liquid used for forming a magnetic film include prepared liquids containing magnetic particles and particles of oxides such as iron oxide. The viscosity of the liquid may fall within the range of 1 P to 500 P, for example.

The reservoir tank 1 and an entrance 21 of the slit die 20 are connected to each other through a line L1. The pump 3 for quantitatively supplying the slit die 20 with the liquid from the reservoir tank 1 is connected to the line L1. Though not restricted in particular, the pump 3 is preferably a precision gear pump. A valve 2 is connected to the line L1.

The guide roll 6 is a cylindrical rotatable roll. The sheet S supplied from the sheet feed reel 5 so as to be taken up by the take-up reel 7 is held and guided by the circumferential surface of the guide roll 6. Though the diameter of the guide roll 6 is not restricted in particular, its outer diameter may be 10 to 250 mm, for example. Though not limited in particular, the rotating speed of the guide roll 6 is preferably set such that the linear velocity at the circumferential surface of the guide roll equals the line speed (the feeding rate of the sheet S). The applied thickness is preferably 100 to 250 μm.

Examples of the sheet S include PET, PEN, and aramid, though not restricted in particular. Its thickness and width may be 5 to 300 μm and 50 to 2000 μm, respectively, for example, though not limited in particular.

As shown in FIG. 1, the slit die 20 has a slit 23 formed with an opening 24 extending in the axial direction of the guide roll 6. The slit die 20 acts such that the liquid flowing from the entrance 21 is widened in the width direction of the sheet S by a manifold 22, which is formed as a void within the slit die 20 such as to extend in the axial direction of the guide roll 6, and then travels the slit 23 so as to be discharged like a film from the opening 24. Thus discharged liquid film L on the sheet S is dried by the dryer 8 while being conveyed by the take-up reel 7. Examples of the dryer include hot ray heaters, vapor heaters, and infrared heaters.

Figure 2:
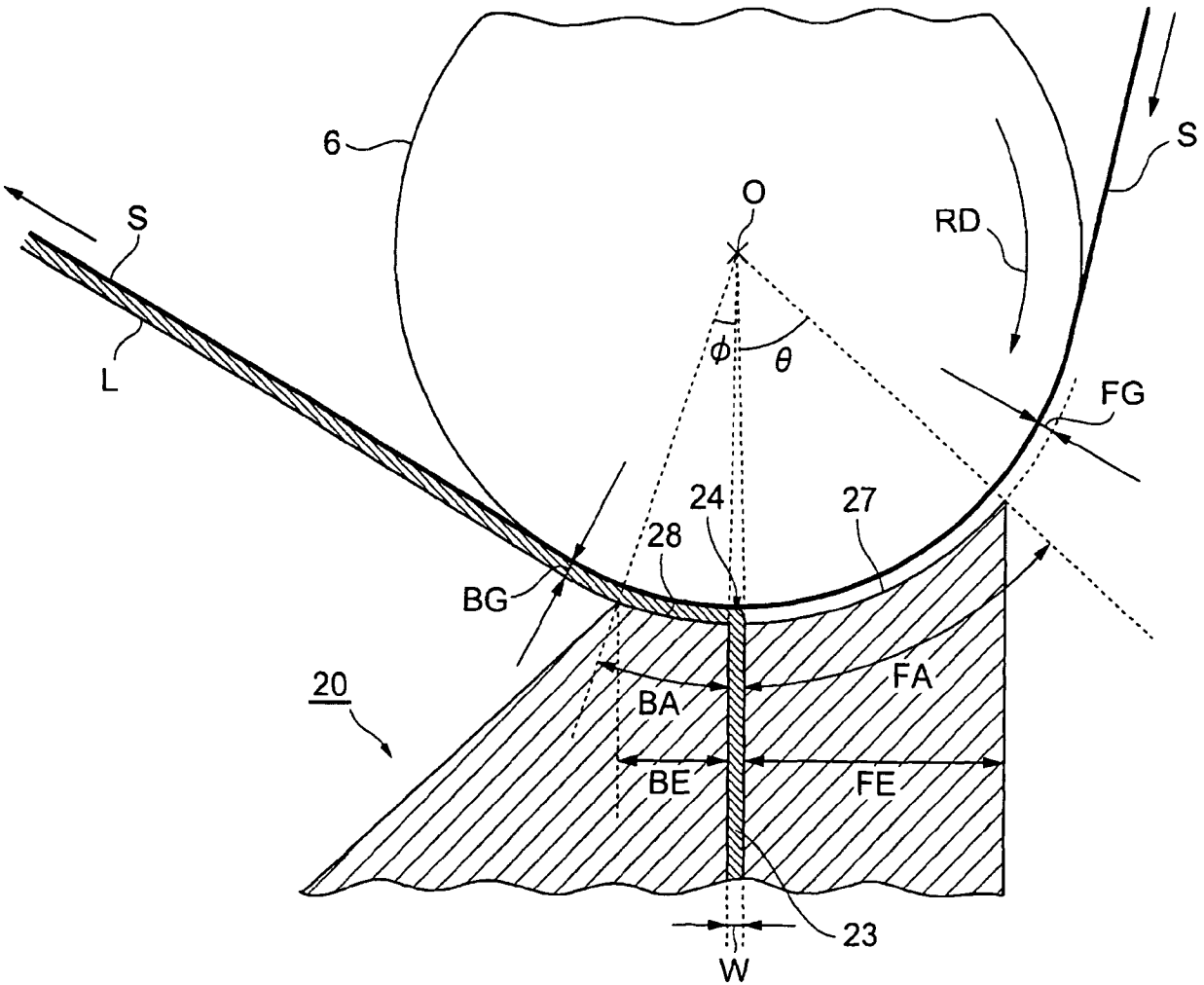
FIG. 2 is an enlarged sectional view of a part where a guide roll and a slit die oppose each other in FIG. 1.

The opening of the slit die 20 and its vicinity will now be explained in detail with reference to FIG. 2.

The diameter W of the slit 23 in the slit die 20 may be 30 to 500 μm, for example, though not restricted in particular.

A back lip 28 is provided on the front side of the opening 24 of the slit 23 in a rotating direction RD of the guide roll 6. The back lip 28 has a concave surface corresponding to the circumferential surface of the opposing guide roll 6, and preferably forms a circular arc whose circumference keeps a fixed distance BG to the guide roll 6.

On the other hand, a front lip 27 is provided on the rear side of the opening 24 of the slit 23 in the rotating direction RD of the guide roll 6. The front lip 27 has a concave surface corresponding to the circumferential surface of the opposing guide roll 6, and preferably forms a circular arc whose circumference keeps a fixed distance FG to the guide roll 6.

Preferably, the distance FG between the front lip 27 and the guide roll 6 is made identical to the distance BG between the back lip 28 and the guide roll 6. The distance BG or FG is preferably 10 to 300 μm, for example.

The circumferential length FA of the front lip 27 in the rotating direction RD of the guide roll 6 is set such as to have a central angle θ of 0.95° to 3.0° about the axis O of the guide roll 6. The circumferential length BA of the back lip 28 in the rotating direction RD of the guide roll 6 is set such as to have a central angle ϕ smaller than θ about the axis O of the guide roll 6.

The length FE of the front lip 27 and the length BE of the back lip 28 in a direction perpendicular to the slit 23 can easily be calculated when θ, ϕ, the diameter of the guide roll 6, and the distances FG, BG between the guide roll 6 and slit die 20 are known.

When the liquid from the reservoir tank 1 is supplied to the slit die 20 by the liquid feed pump 3 in thus constructed applicator 100, the liquid is discharged from the opening 24 after traveling the manifold 22 and slit 23 and applied like a film onto the sheet S guided by the guide roll 6. The applied liquid film L is stabilized between the surface of the back lip 28 and the sheet S, so as to be uniformly applied onto the sheet S.

Since the front lip 27 has an appropriate length in this embodiment, the entrainment of air from the rear side into the liquid film L applied to the sheet S between the back lip 28 and the guide roll 6 is suppressed, which reduces the fluctuation in thickness of the applied liquid film in the width direction. When the length FA by which the front lip 27 opposes the guide roll 6 is set such that the central angle θ is less than 0.95°, by contrast, the air is entrained remarkably, so that the thickness of the liquid film L fluctuates in the width direction. When the central angle θ exceeds 3.0°, on the other hand, a backflow of the liquid occurs between the front lip 7 and the guide roll 6, whereby the thickness of the liquid film L fluctuates in the width direction.

Further, the length BA by which the back lip 28 opposes the guide roll 6 in the rotating direction of the guide roll 6 is set such that the central angle ϕ about the axis O of the guide roll 6 is smaller than the central angle θ in this embodiment. This can restrain stripes from occurring. The present invention can also be carried out when θ<ϕ.

The present invention can be modified in various ways without being restricted to the above-mentioned embodiment.

When the back lip 28 is short, for example, it may have a planar surface instead of the concave surface. Also, the surfaces of the back lip 28 and front lip 27 may have fine irregularities.

EXAMPLES

Example 1

Using a guide roll having a radius of 60.2 mm and a slit die with a slit width of 300 μm, a prepared liquid containing an oxide was applied to a surface of an Al sheet having a thickness of 20 μm and a width of 150 mm. FIG. 3 shows θ, ϕ, FE, BE, and the gap BG, FG in the slit die. The BG and FG were made identical to each other. The sheet feeding rate was 15 m/min, so that the liquid film attained a thickness of 120 μm. The fluctuation in thickness of the applied film after drying was investigated with a microscope and the measurement of thickness by a micrometer, so as to determine the range of fluctuation. The range of fluctuation was defined by the maximum deviation/average value.

Examples 2 to 4 and Comparative Examples 1 and 2

Same as Example 1 except that θ was changed as shown in FIG. 3.

Examples 5 to 8 and Comparative Examples 3 and 4

Same as Examples 1 to 4 and Comparative Examples 1 and 2, respectively, except that the radius of the guide roll was changed to 55 mm.

Examples 9 to 12 and Comparative Examples 5 and 6

Same as Examples 1 to 4 and Comparative Examples 1 and 2, respectively, except that the gap BG, FG was changed to 0.1 μm.

Examples 13 to 16 and Comparative Examples 7 and 8

Same as Examples 1 to 4 and Comparative Examples 1 and 2, respectively, except that ϕ of the back lip was changed to 3.7°.

The fluctuation in the film was fully suppressed in the width direction when θ was 0.95° to 3.0°.

What is claimed is:

1. A liquid applicator comprising:

a guide roll for guiding a sheet; and a slit die, having a slit with an opening extending in an axial direction of the guide roll, for applying a liquid to a surface of the sheet guided by the guide roll; wherein the slit die further includes a front lip placed on the rear side of the opening in a rotating direction of the guide roll, the front lip having a concave surface corresponding to the guide roll, the front lip opposes the guide roll by such a length in the rotating direction of the guide roll as to have a central angle θ of 0.94° to 2.83° about an axis of the guide roll, the slit die further includes a back lip placed on the front side of the opening in the rotating direction of the guide roll, the back lip having a concave surface corresponding to the guide roll, and the back lip opposes the guide roll by such a length in the rotating direction of the guide roll as to have a central angle ϕ which is smaller than θ about the axis of the guide roll.

2. The liquid applicator according to claim 1, wherein a diameter of the slit is 30 to 500 μm.

3. The liquid applicator according to claim 2, wherein the slit die is for applying the liquid so that applied thickness of the liquid is 100 to 250 μm.

* * * * *